US005228481A

United States Patent [19]

Kimbara et al.

[11] Patent Number: 5,228,481

[45] Date of Patent: Jul. 20, 1993

[54] METHOD AND APPARATUS FOR WEAVING ROD PIERCING TYPE THREE-DIMENSIONAL MULTIPLE-AXIS FABRIC

[75] Inventors: Masahiko Kimbara; Makoto Tsuzuki, both of Tsukuba, Japan

[73] Assignee: Three-D Composites Research Corporation, Tsukuba, Japan

[21] Appl. No.: 778,859

[22] PCT Filed: Apr. 26, 1991

[86] PCT No.: PCT/JP91/00577

§ 371 Date: Jan. 8, 1992

§ 102(e) Date: Jan. 8, 1992

[87] PCT Pub. No.: WO91/17293

PCT Pub. Date: Nov. 14, 1991

[30] Foreign Application Priority Data

May 9, 1990 [JP] Japan ..... 2-119240

[51] Int. Cl.[5] ..... D03D 41/00

[52] U.S. Cl. ..... 139/11; 139/DIG. 1; 156/148; 156/393; 428/109; 428/113; 428/119; 428/902

[58] Field of Search ..... 139/11, DIG. 1, 408; 156/148, 393; 428/109, 902, 119, 113

[56] References Cited

U.S. PATENT DOCUMENTS 3,955,602 5/1976 King ..... 139/11
4,038,440 7/1977 King .
4,165,355 8/1979 Vasilos .
5,076,330 12/1991 Kimbara et al. ..... 139/11
5,178,705 1/1993 Kimbara et al. ..... 139/11 X

FOREIGN PATENT DOCUMENTS 0166631 1/1986 European Pat. Off. .
291263 3/1990 Japan .
2104742 4/1990 Japan .
2112441 4/1990 Japan ..... 139/11
2169741 6/1990 Japan .

*Primary Examiner*—Andrew M. Falik
*Attorney, Agent, or Firm*—Oblon, Spivak, McClelland, Maier & Neustadt

[57] ABSTRACT

A weaving mechanism for producing rod piercing type three-dimensional multiple-axis fabrics using a fall-preventive wall to prevent fall-off of inserted weft rods. The weaving mechanism being adapted to obviate the use of wastefully lengthy weft rods. For inserting weft rods into a warp rod group obliquely from a plural number of directions in the weaving process of a three-dimensional multiple-axis fabric, the inserted weft rod portions which protrude out of the warp rod group are received by a fabric guide which constitutes a fall-preventive wall. The fabric guide which guides the woven fabric is formed in a cylindrical shape enveloping the woven fabric in small gap relation therewith when seen in the axial direction of the warp rods. The weft rods are inserted at a position outside an end portion of the fabric guide or through notched grooves in the fabric guide.

14 Claims, 6 Drawing Sheets

METHOD AND APPARATUS FOR WEAVING ROD PIERCING TYPE THREE-DIMENSIONAL MULTIPLE-AXIS FABRIC

BACKGROUND OF THE INVENTION

1. Field of the Invention

This invention relates to a method and apparatus for weaving rod piercing type three-dimensional multiple-axis fabric.

2. Discussion of the Related Art

In a co-pending prior application H2-91263, the present inventors proposed a weaving machine for rod piercing type three-dimensional multiple-axis fabric, in which three-dimensional fabric is woven by inserting a group of weft rods into a plural number of parallelly arranged warp rods from a plural number of directions. The weaving machine of this kind involves three problems as discussed below.

First, in a weaving machine for rod piercing type three-dimensional fabric, the fore ends of inserted weft rods are retained on a fall-preventive wall which prevents the weft rods from falling off. In step with the progress of a weaving operation, the fall-preventive wall is fed sequentially in the weaving direction along with a rod support plate, which supports a woven part of fabric and the warp rods, thereby forming three-dimensional fabric to a desired length.

However, a weaving machine, which is arranged to feed the fall-preventive wall along with woven fabric and rod support plate, requires the inserting weft rod group to have a length which is far longer than the length which is necessary for the fabric, as explained below with reference to FIG. 8.

More specifically, in a weaving process for three-dimensional four-axis fabric with a hexagonal shape in section as shown in FIGS. 8 to 10, in order to insert, from each of three arrowed directions, a group of flatly arrayed weft rods 2 into a group of warp rods 1 which are arranged vertically relative to the face of the drawing, it is necessary to secure an insertion space S for each weft rod group to be inserted by a rod insertion mechanism 15, and to provide a fall-preventive wall W for each one of the weft rod groups. For these purposes, the fall-preventive walls W, which need to have a width almost the same as the width of the insertion space S, have to be located at a relatively large distance from the warp rod group 1, and, in order to abut the fore ends of the weft rod groups against the fall-preventive walls W, the weft rods are required to have a length far longer than the length which is needed for weaving the three-dimensional fabric, as indicated at L in the same figure.

Thus, in case of a rod piercing type three-dimensional multiple-axis fabric weaving machine which is arranged to move the fall-preventive walls W up and down together with the woven fabric for the purpose of retaining the fabric in a stabilized state, wastefully lengthy weft rods are needed because of the layout of the rod insertion means which has to be located in such a way as to evade the fall-preventive walls, and there is a necessity for considering a countermeasure to this problem.

The second problem concerns the beating operation in the weaving process of three-dimensional fabrics having four axes or more.

A rod piercing type three-dimensional three-axis fabric can be woven by inserting weft rods into a large number of parallelly disposed warp rods from two perpendicularly intersecting directions. In a weaving machine for such three-dimensional three-axis fabric, the inserting weft rods are arrayed in parallel relation with each other, so that it is possible to beat the inserted weft rods successively by means of a beater with a large number of holes for threading the weft rods therethrough.

However, in case of three-dimensional fabric of four or more axes as shown in FIGS. 1, 9 and 10, the weft rod groups, to be inserted into a group of warp rods from a plural number of directions, are not disposed in parallel relation with each other and are projected with complicated inclinations which make the beating operation as mentioned above difficult. Therefore, a suitable beating means needs to be developed in order to weave a three-dimensional fabric by insertion of weft rods which are arrayed in high density.

The third problem concerns the arrangement of the weft rods to be inserted.

In this connection, the present inventors made a proposal in their copending prior application H2-99659 with regard to three-dimensional multiple-axis fabric woven from matrix-bound roving rods which are arranged in the directions of the respective axes.

In case of the rod piercing type three-dimensional fabric of this sort, more specifically, of the three-axis fabric having the respective rod groups disposed in perpendicularly intersecting relation with each other, it is possible to insert the two perpendicularly intersecting weft rod groups, each arrayed flatly in one plane, alternately group by group into a large number of parallelly disposed rods of the warp group.

However, the insertion of flatly arrayed weft rods is difficult in case of a three-dimensional fabric of four axes or more.

More specifically, referring to FIGS. 9 and 10 which show the construction of a three-dimensional four-axis fabric, and particularly to FIG. 10 which shows a three-dimensional four-axis fabric 50 being formed by inserting inclined weft rod groups 2 into a parallelly disposed weft rod group 1 from three different directions, seen in the direction of insertion of one of the weft rod groups 2. As seen in that figure, the rods 2A, 2B, 2C, 2D and 2E or the rods 2A, 2B, 2C', 2D' and 2E' of the weft rod group 2, which is inserted into the warp rod group 1 from one direction in a cycle of weaving operation, are disposed in a complicated inclined plane $P_3$ relative to a number of parallel planes $P_1$ and $P_2$ which are located in slightly deviated positions along the warp rod group 1 in the weaving direction or relative to the warp rod group 1. Accordingly, if the rods of the weft rod group 2 were to be inserted into the warp rod group 1 simultaneously from one direction in one cycle of weaving operation, it would become necessary for the weaving machine to employ a weft rod insertion mechanism which is adapted to support the inserted weft rods respectively on surfaces of different levels and to array the weft rods on a surface in a complicated inclined state before insertion, resulting in complication in construction and fabrication process of the weft rod insertion mechanism.

In conventional arrangements such as disclosed in, for example, U.S. Pat. No. 5,076,330, a reed is not rotated if it is provided with a plurality of weft rod inserters (see column 9, lines 5–13 of U.S. Pat. No. 5,076,330). In the present invention, a weft rod inserter is provided for each direction of weft rod insertion, and components for warp rod insertion are not rotated around a vertical axis.

SUMMARY OF THE INVENTION

It is a primary object of the present invention to provide a weaving means which can obviate the use of wastefully lengthy weft rods, while preventing fall-off of inserted weft rods by means of fall-preventive walls in a weaving process of rod piercing type three-dimensional multiple-axis fabric.

It is another object of the present invention to provide a weaving method and machine employing a fall-preventive wall as a fabric guide for guiding woven part of fabric in a weaving process of three-dimensional fabric, the fabric guide also serving as a container for holding a matrix resin to be impregnated into the woven fabric and being adapted to receive supply of the matrix resin concurrently with the weaving operation to impregnate the resin into the woven fabric and cure the same as a matrix.

On the other hand, the present inventors conducted weaving operations, forming three-dimensional multiple-axis fabrics by the use of actual rods on a machine with the above-mentioned fabric guide, to study the properties of the woven fabrics in greater detail, and as a result have confirmed that beating is possible by pressing inserted weft rod portions, which protrude on the outer side of the warp rod group, in the axial direction of the warp rod group.

It is conceivable that, in case of a three-dimensional fabric of four axes or more, the weft rods which have been inserted into the warp rods from a number of different directions are held in interlaced relation with each other in such a way as to bear the pressing force without causing disintegration of the woven structure when partly pressed at the protruded portions. This tendency is observed more conspicuously especially in a case where weft rods are inserted in higher density into warp rods which are arrayed in fixed state.

It is a further object of the present invention to provide, on the basis of the above-mentioned finding, a beating means which is simple in construction and yet capable of performing effective beating in a weaving process of rod piercing type three-dimensional multiple-axis fabric having four axes or more.

It is still another object of the present invention to cope with the difficulty of inserting flatly arrayed weft rods, as explained hereinbefore with reference to the fabric construction of FIGS. 9 and 10, namely, to simplify the mechanism of inserting weft rods in the weaving process of three-dimensional multiple-axis fabric, especially by supporting the inserted weft rods on a flat rod support surface which is mounted in position with simple orientation.

It is a further object of the present invention to provide a weft rod insertion mechanism for three-dimensional multiple-axis fabric, which can contribute to simplify the insertion mechanism as a whole by employing a simple means for inserting the rods of the weft rod group in a divided fashion in each cycle of weaving operation.

In accordance with the invention, there is provided, for achieving the above-stated objectives, a method for weaving a rod piercing type three-dimensional multiple-axis fabric, fundamentally comprising: inserting weft rods through a warp rod group by means of a rod inserting means, while receiving protruded fore end portions of the inserted weft rods by a fabric guide constituting a fall-preventive wall on the outer side of the fore ends of the inserted weft rods; the fabric guide being formed in a cylindrical shape enveloping the woven fabric to guide the same in small gap relation therewith when seen in the axial direction of the warp rods. In the weaving process, the fabric guide is successively fed in the axial direction of and relative to the warp rod group together with the rod inserting means, while the weft rods are inserted by the rod inserting means at a position outside an end portion of the fabric guide or through notched grooves in the fabric guide.

Upon insertion of the weft rods, the weft rod group to be inserted from one direction in one cycle of weaving operation are arrayed in parallel relation with each other in a plane which perpendicularly intersects a plane parallel with both the warp and weft rods and which contains the weft rods. The arrayed weft rods are successively fed in the axial direction of and relative to the warp rod group, in such a manner that they can be selectively inserted in each cycle of weaving operation by means of a rod inserting means which permits divided insertion of the weft rods at a plural number of positions corresponding to weft rod insert portions inbetween the warp rods.

On the other hand, in the three-dimensional multiple-axis fabric weaving machine of the present invention, the fall-preventive wall, which is positioned face to face with the weft rods being inserted through the warp rod group by a rod inserter in the above-described rod type three-dimensional multiple-axis fabric weaving machine, is constituted by a cylindrical fabric guide enveloping the woven fabric in small gap relation therewith when seen in the axial direction of the warp rods. The fabric guide is movable together with the rod inserter in the axial direction of and relative to the warp rod group, and the rod inserter is located in such a way as to insert the weft rods at a position outside an end portion of the fabric guide or through notched grooves in the fabric guide.

With the weaving machine of the above-described arrangement, there is no necessity for evading the fall-preventive wall in locating the rod inserter as explained hereinbefore with reference to FIG. 8, because the fabric guide has the function of the fall-preventive wall irrespective of the location of the rod inserter. Therefore, the weft rods can be set in a length which is necessary for the fabric to be woven, obviating the use of wastefully long rods.

In the above-described weaving machine, the fabric guide also serves as a container for holding a matrix resin to be impregnated into the woven fabric, and for this purpose it is associated with a resin feeder having a resin supply port opened above the fabric guide to supply the matrix resin thereto, and with an energy supply means for curing the impregnated resin. With this arrangement, the matrix resin is supplied to the fabric guide concurrently with the weaving operation to impregnate and cure the resin in the woven fabric. The cylindrical fabric guide is preferably tapered on the inner periphery thereof to have a gradually converging sectional area from the weaving position correspondingly to the contraction of curing matrix resin.

Further, in the weaving machine of the present invention, the weft rods of the group which is inserted from one direction in one cycle of weaving operation are arrayed on a rod support surface which perpendicularly intersects a plane parallel with both the warp and weft rods and which contains the weft rods. The rod inserter, which is adapted to press the arrayed weft rods on the rod support surface and insert same into the warp rods, is capable of dividing the insertion of the weft rods correspondingly to their positional difference in the weaving direction in each cycle of weaving operation if desired. For the divided insertion, the push rod which pushes and inserts the weft rods is divided into push rod sections correspondingly to a plural number of parallel planes of weft rod insertion which are deviated from each other in the weaving direction. The divided push rod sections are located face to face with the weft rods at the respective fore ends and separately coupled with drive members which are located slidably on a machine frame. The push rod section of the drive member which is located on the side away from the warp rod group is slidably passed through the drive member located on the side of the warp rod group. The respective drive members are moved in the direction of weft rod insertion independently of each other by means of a drive mechanism. In this regard, it is also possible to employ a rod inserter which has a plural number of push rods on a single drive member at intervals two times as wide as the pitch of rod arrangement of the warp rod group, in combination with a transverse drive mechanism which moves the rod inserter in the transverse direction by one pitch of the warp rod arrangement.

In case of a rod piercing type three-dimensional multiple-axis fabric which has four axes or more, usually the fabric construction makes it difficult to array all the rods in each weft rod group on a simply oriented flat surface and to insert them at one time from one direction in one weaving cycle. However, as described hereinbefore, the rod inserter which can divide the rod insertion at a plural number of weft rod insert positions permits to insert selectively the weft rods of desired positions, and contributes to simplify the weft rod insert mechanism to a marked degree.

Further, the weaving machine of the invention is provided with a rod pressing frame which is movable relative to the woven fabric in the axial direction of the warp rod group for beating operation, the rod pressing frame being formed substantially in a ring-like shape circumventing the warp rod group in face to face relation with the inserted weft rod portions protruding outwardly through the warp rod group, and having a rod pressing surface which is adapted to simultaneously abut against the weft rods upon completion of weft rod insertion of one weaving cycle.

Furthermore, the rod pressing frame of the above-described weaving machine can also be arranged to have functions as a guide in the direction of the weft rod insertion.

In the above-described weaving machine, the pitch between weft group rods can be narrowed in the three-dimensionally arranged state by beating the inserted weft rods through relative movement of the woven fabric in the axial direction of the warp rod group. This is because the inserted weft rods from different directions are interlaced with each other inbetween the warp rod group in case of a three-dimensional multiple-axis fabric of four axes or more, and disintegration of the woven structure would not occur easily even if part of the inserted weft rods were pressed in the axial direction of the warp rod group.

Accordingly, there can be obtained a beater of simple construction which is capable of effective beating in the weaving process of three-dimensional multiple-axis fabric.

DESCRIPTION OF THE PREFERRED EMBODIMENTS

The roving to be used in the present invention for weaving three-dimensional multiple-axis fabric is bound into the shape of rods beforehand by the use of a matrix resin, and the resulting rods are fed to a weaving process as explained below.

Figure 1:
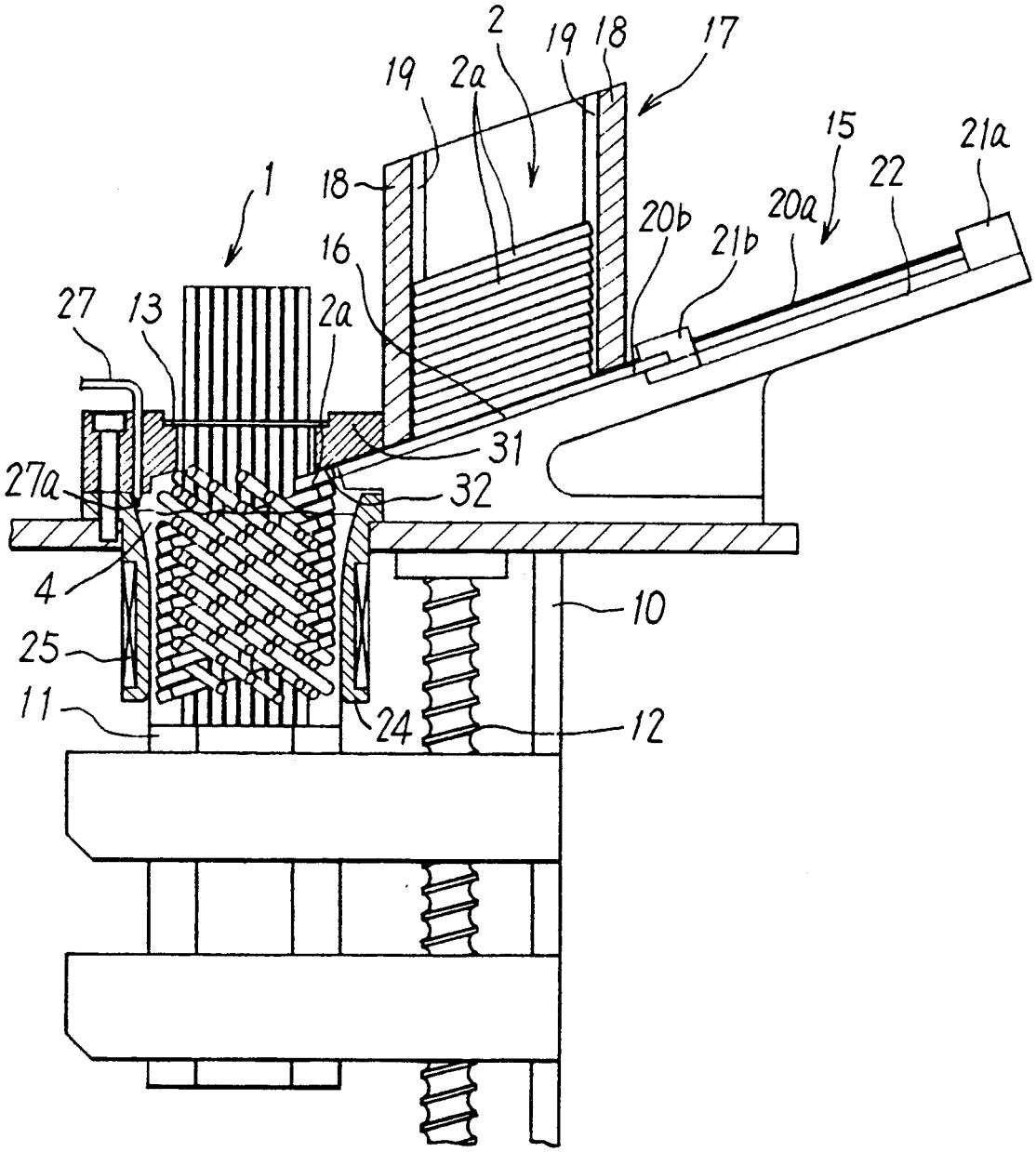
FIG. 1 is a sectioned side view of essential parts of a three-dimensional multiple-axis fabric weaving machine according to the present invention.
Figure 2:
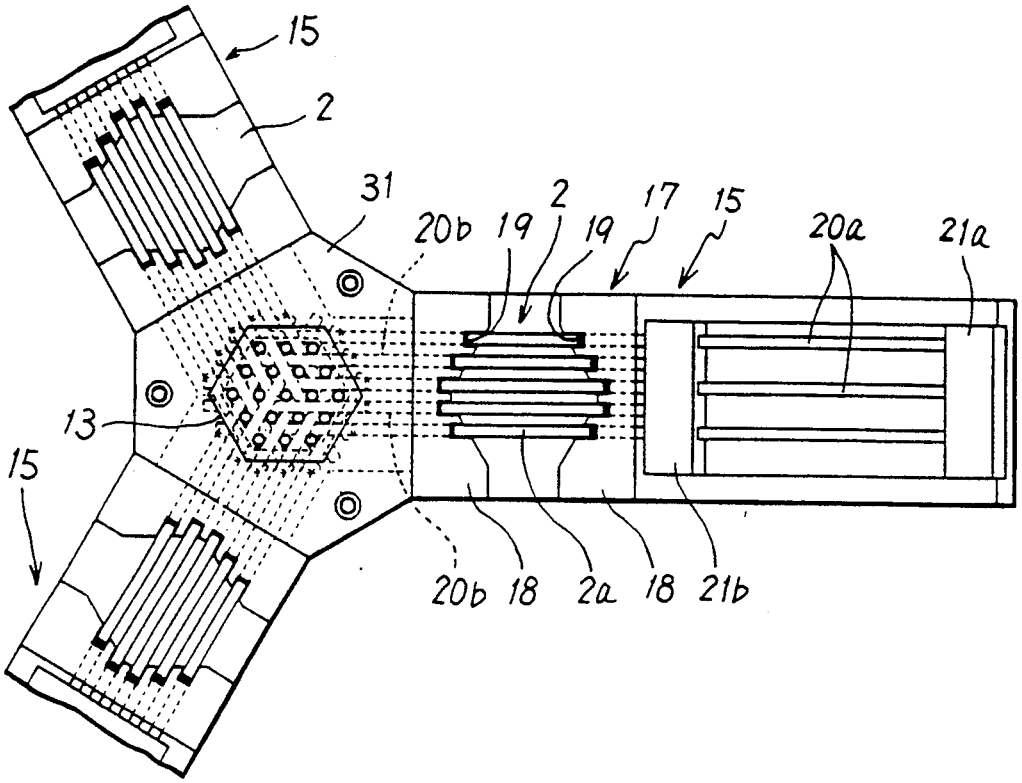
FIG. 2 is a plan view of essential parts of the same weaving machine.
Figure 3:
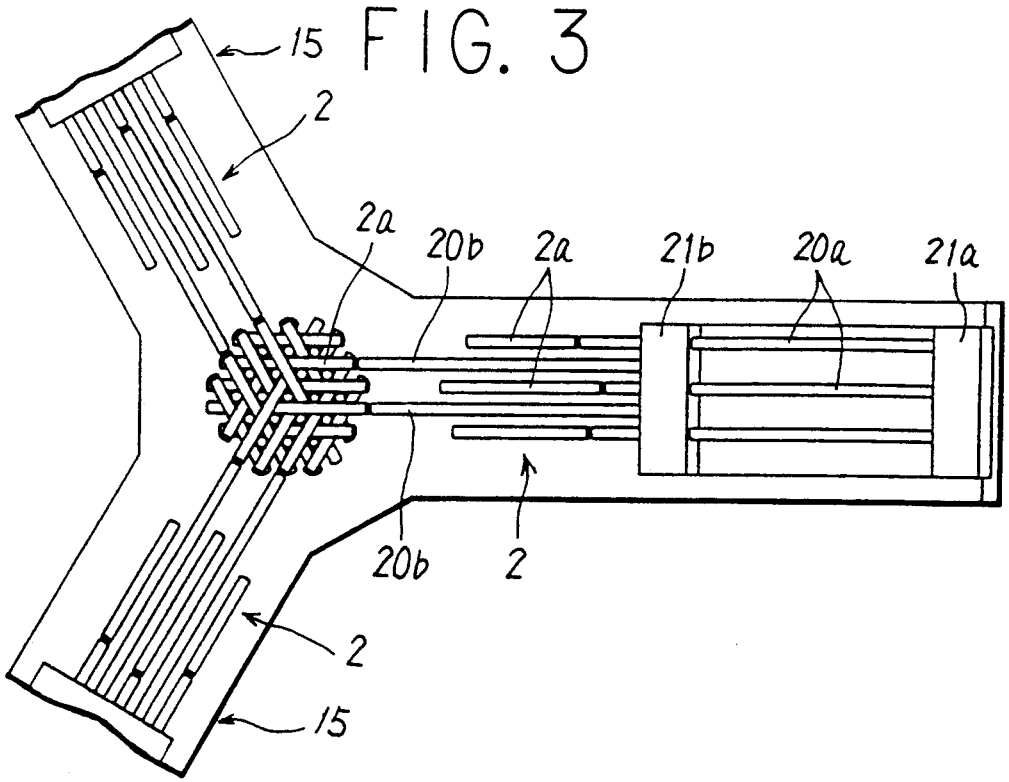
FIG. 3 is a partly cutaway plan view explanatory of the condition of inserted weft rods on the weaving machine.

Referring to FIGS. 1 to 3, there is shown the construction of a three-dimensional multiple-axis weaving machine according to the present invention. The three-dimensional multiple-axis weaving machine is provided with a holder table 11 on a machine frame 10 to hold a large number of rods of a warp rod group 1 parallelly at predetermined intervals, the holder table 11 being lifted up and down by a feed screw 12. A perforated plate 13 is mounted on a rod pressing frame 31 on the machine frame 10 thereby to hold upper portions of the warp rod group 1.

A rod inserter 15 which inserts a weft rod group 2 into the warp rod group 1, is provided with a rod support surface 16 to array thereon a weft rod group 2 to be inserted from one direction in one weaving cycle. The rod support surface 16 is tilted according to the construction of the multiple-axis fabric to be woven, and disposed in a plane which perpendicularly intersects a plane parallel with both the warp and weft rods and which contains the weft rods.

With the progress of a weaving process, the weft rods supported on the rod support surface 16 need to be fed successively in the weaving direction of and relative to the warp rod group 1 and to be retained in a suitable weaving position for insertion into the warp rod group 1. This relative movement can be attained by lifting up and down the holder table 11 of the warp rod group 1 through the feed screw 12 as mentioned hereinbefore, or by other means which is arranged to move the weft rods relative to and in the axial direction of the warp rod group 1.

The rod inserter 15, which presses and insert the arrayed weft rods on the support surface 16 into the warp rod group 1 in each weaving cycle, is associated with a rod magazine 17 which supplies a group of weft rods 2 successively onto the support surface 16 for each weaving cycle. In order to supply the weft rods in the arrayed state, the rod magazine 17 is arranged to hold the weft rods 2*a* in nesting grooves 19 which are provided between a couple of opposingly located walls 18. In step with the progress of the weaving operation, the weft rods 2*a* retained in the nesting grooves 19 are successively dropped and fed onto the rod support surface 16. The weft rods 2*a* to be retained in the nesting grooves 19 have preadjusted lengths according to the shape of the three-dimensional multiple-axis fabric to be produced.

Figure 9:
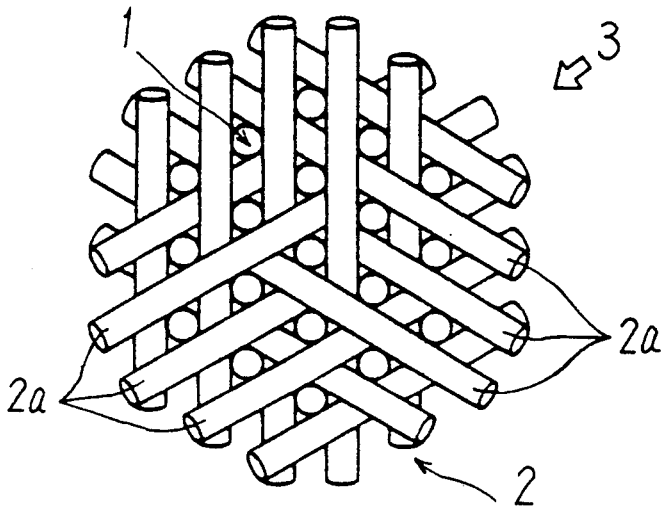
FIGS. 9 and 10 are a plan view and a perspective view, taken in the direction of weft rod group, of a construction of three-dimensional four-axis fabric woven by the weaving machine of the invention.
Figure 10:
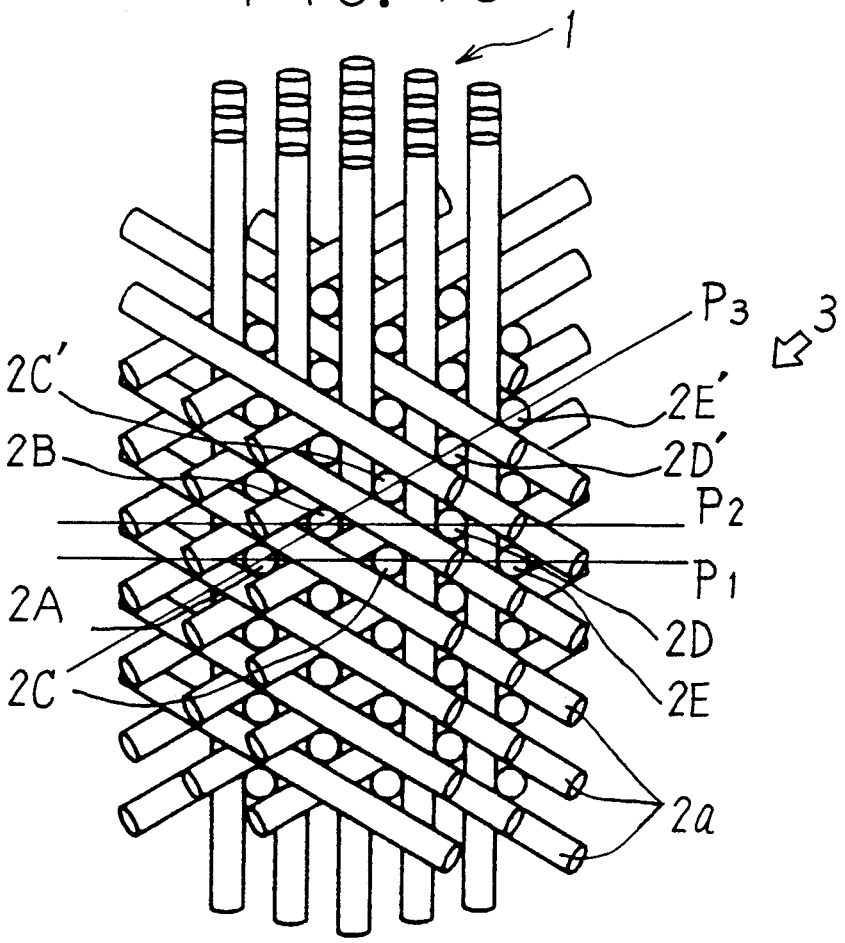

This three-dimensional multiple-axis weaving machine can weave, for example, a multiple-axis fabric 3 as shown in FIGS. 9 and 10. In case of the three-dimensional multiple-axis fabric of this sort, the rods of a weft group, which are arrayed in a plane on the support surface 16 for insertion from one direction in each weaving cycle, cannot be inserted into the warp rod group at one time.

More specifically, in case of the three-dimensional four-axis fabric 3 which has the weft rod groups 2 inserted in inclined state into a warp rod group 1 from three different directions as seen in FIG. 10, the rods of the weft groups 2 of each weaving cycle are located in a plural number of parallel planes $P_1$ and $P_2$ which are slightly deviated from each other in the weaving direction of the warp rod group 1 as explained hereinbefore. Therefore, the push rod which presses the weft rods for insertion is divided into push rod sections 20*a* and 20*b* correspondingly to the weft rods 2*a* in these planes $P_1$ and $P_2$, the divided push rod sections 20*a* and 20*b* being individually connected to drive members 21*a* and 21*b* in such a way as to confront the weft rods 2*a* at the respective fore ends. The drive members 21*a* and 21*b* are slidably mounted on a slide table 22 which is provided on the machine frame 10, and are independently pushed forward by hydraulic cylinders (not shown) or other drive mechanism in the direction of insertion of the weft rods 2*a*. The push rod 20*a* of the drive member 21*a* which is located most distantly from the warp rod group 1 is slidably passed through the drive member 21*b* which is located closer to the warp rod group 1.

In order to weave a three-dimensional four-axis fabric as shown in FIGS. 9 and 10, the weft rod inserter 15 is provided in three positions around the warp rod group 1 to insert the weft rods from three different directions.

While lowering the warp rod group 1 in step with the progress of the weaving operation, the weft rods 2*a* are inserted into the warp rod group 1 by the rod inserters 15 by selectively projecting the push rods 20*a* and 20*b* through the drive members 21*a* and 21*b* at a plural number of positions corresponding to weft rod insert portions in the warp rod group 1, thereby protruding the selected push rods 20*a* and 20*b* and pushing the corresponding weft rods on the rod support surface 16 with the fore ends of the protruded push rods to insert them successively into the warp rod group 1 in a divided fashion.

FIG. 3 shows the manner in which the weft rods in the plane $P_2$ are inserted by the protruding fore ends of the push rods 20*b* driven by the drive member 21*b*. If the push rods 20*b* were fully retracted by the drive member 21*b* from the position shown in FIG. 3, they might obstacle the next divided insertion by the drive member 20*a*. Therefore, the drive member 21*b* is temporarily retained in a slightly retracted position and retracted once again at the time of the next divided insertion by the push rods 20*b*.

The weft rod inserter of the above arrangement can simplify the weft rod insertion mechanism for the three-dimensional multiple-axis fabric, especially the mechanism of feeding the weft rods to be inserted.

Figure 4:
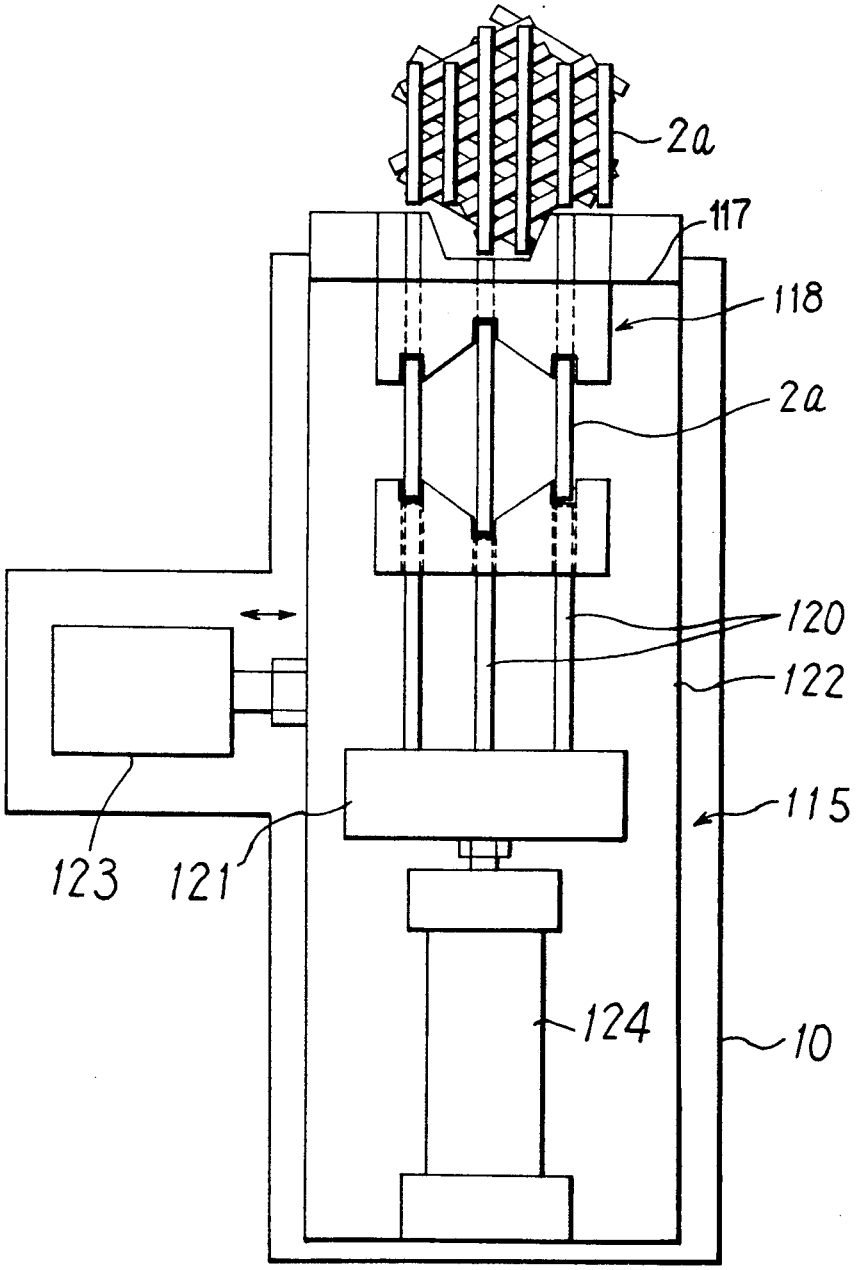
FIG. 4 is a plan view of a rod inserter of modified construction.

Illustrated in FIG. 4 is an embodiment which is arranged to shift the positions of push rods transversely for insertion of different weft rods 2*a*, instead of operating the push rods in a divided fashion. This embodiment is provided with a rod inserter 115 including a rod magazine 117, similar in construction to the rod magazine in the foregoing embodiment, and push rods 120 connected to a single drive member 121 on a slide table 122. The rod inserter 115 as a whole is transversely movable over a distance corresponding to one pitch of the arrayed warp rods, by means of a transverse drive cylinder 123. As a consequence, for selective insertion of the weft rods, the rod inserter 115 is moved transversely into a selected insert position to permit successive divided insertions of the weft rods 2*a*.

In this embodiment, the weft rods 2*a* to be inserted and the push rods 120 are arrayed at intervals which are two times as wide as the pitch of warp rod arrangement. In FIG. 4, the reference numeral 124 denotes a cylinder for weft rod insertion.

In the embodiment of FIGS. 1 to 3, the cylindrical fabric guide 24, which is mounted on the machine frame 10 in such a manner as to circumvent the three-dimensional fabric 3, has part of its body located forward of the weft rods 2*a* to be inserted through the warp rod group 1 by the rod inserter 15, so that it functions as a fall-preventive wall which catches the inserted weft rods to prevent the same from falling. The inner periphery of the fabric guide 24 is formed in a cylindrical shape surrounding the woven fabric 3 in small gap relation therewith, when seen in the axial direction of the warp rod group 1.

The insertion of the weft rods 2*a* by the rod inserter 15 is effected at a position above the upper end of the fabric guide 24, or alternatively effected through notched grooves formed in an upper portion of the fabric guide.

The fabric guide 24 is fixed on the machine frame 10, and accordingly movable together with the rod inserter 15 relative to and in the axial direction of the warp rod group 1.

The fabric guide 24, which has the function of guiding the woven fabric, also serves as a container which forms a resin impregnating section for holding and preventing dripping of a matrix resin to be impregnated into the woven fabric. For this purpose, it is arranged to receive a supply of matrix resin during the weaving operation to impregnate and cure the resin in the woven fabric. The cylindrical fabric guide is tapered on its inner periphery converging gradually from the weaving position to adapt itself to the cure shrinkage of the matrix resin. A matrix resin supply port 27*a* which is in communication with a resin feed pipe 27 is opened in an upper portion of the fabric guide 24. Further, the fabric guide 24 is tapered on its inner periphery to have a sectional area converging gradually from the weaving position in conformity with the contraction of the curing matrix resin. The rate of curing contraction of a resin material which is generally used as a matrix is about 2%–3% in length, so that it is advisable to reduce the sectional area by several percent in tapering the inner periphery.

The fabric guide 24 is further provided with an energy supply means for curing the injected matrix resin.

In the particular embodiment shown, the energy supply means is constituted by a heater 25 which is arranged to heat the matrix resin to a curing temperature. However, there may be employed other heat generating means for curing the resin. For this purpose, curing energy such as ultraviolet or infrared rays may be irradiated from outside the fabric guide 24 if desired.

Further, according to the weaving method of the invention, in a weaving process where weft rods are successively inserted from a plural number of oblique directions relative to a warp rod group which is set in arrayed state on a rod pressing frame, the rod pressing frame, which is located in face to face relation with the inserted weft rod portions protruding out of the warp rod group, is adapted to function also as a beating member, moving the beating member together with the woven fabric in the axial direction of and relative to the warp rod group for beating the inserted weft rods.

Figure 5:
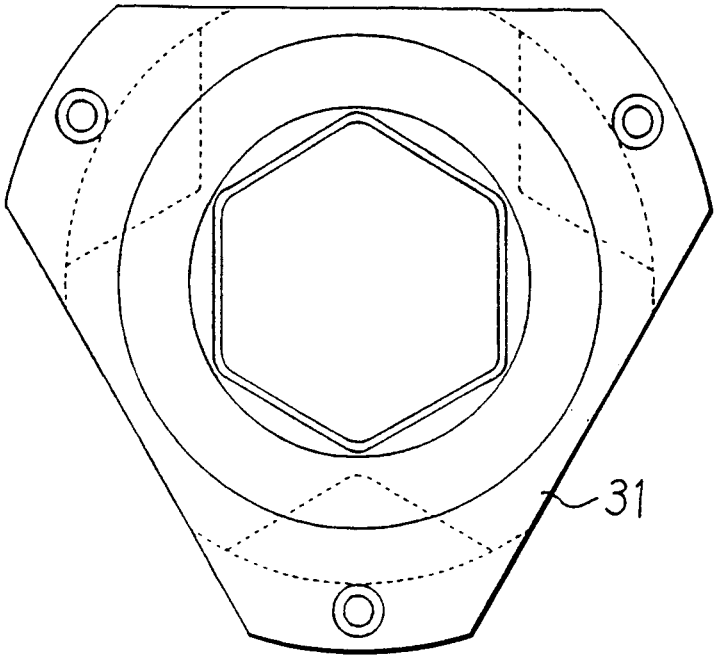
FIG. 5 is a plan view of a rod pressing frame on the weaving machine.
Figure 6:
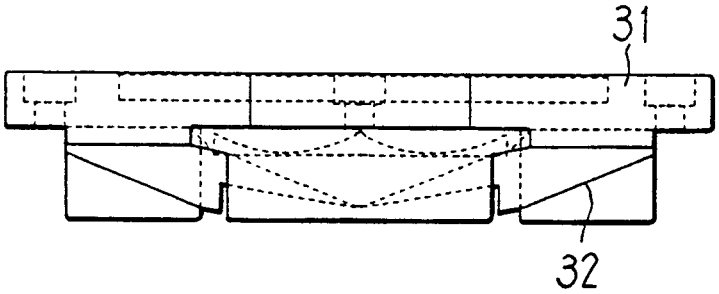
FIG. 6 is a front view of the rod pressing frame.
Figure 7:
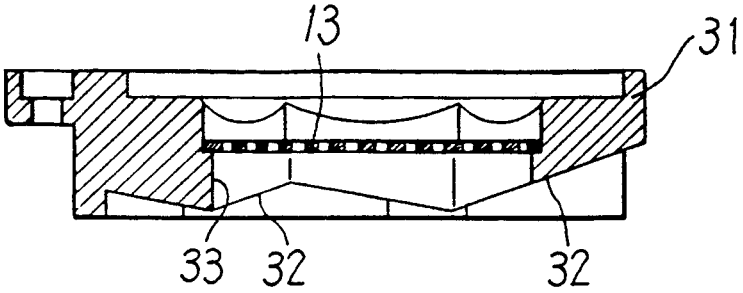
FIG. 7 is a partly sectioned side view of the rod pressing frame.

In order to beat the three-dimensional multiple-axis fabric intermittently during the weaving process of the three-dimensional multiple-axis fabric, the rod pressing frame 31 which has the functions of a beater is mounted on the machine frame 10 over the weaving position. As shown particularly in FIGS. 5 to 7, the rod pressing frame 31 is formed substantially in a ring-like shape which is located to circumvent the warp rod group 1 in face to face relation with the weft rod portions protruding out of the warp rod group 1. The rod pressing frame 31 is provided with a rod pressing surface 32 which is disposed in face to face relation with the weft rods and formed in a shape conforming with a finally beaten shape of the weft rods 2*a*, namely, in a shape which hits simultaeously against the weft rods 2*a* at the end of a pressing operation on the inserted weft rods 2*a* subsequent to the weft rod insertion in each weaving cycle. The warp rods are passed through apertures in a perforated plate 13 which is fitted in an opening 33 of the rod pressing frame 31.

For beating the woven three-dimensional fabric 3 by the rod pressing frame 31, the holder table 11 is moved through operation of the feed screw 12 in the axial direction of the warp rod group 1 each time weft rods 2*a* are inserted by the push rod 20*a* or 20*b* relative to a plural number of warp rods 1 which are set in arrayed positions by the holder table 11, thereby bringing the rod pressing frame 31 into pressing engagement with the inserted weft rod portions protruding out of the warp rod group 1.

In the case of a fabric according to the present invention, since the weft rods 2*a* which have been inserted among the warp rod group from different directions to each other are interlaced, the woven structure would not disintegrate easily even if a pressure of warp direction is exerted on the peripheral part of the inserted weft rods 2*a*.

Accordingly, it is possible to carry out the beating operation without consolidating the inserted weft rods 2*b* entirely as mentioned hereinbefore.

Alternatively, the beating can be performed by pressing the rod pressing frame 31 against the woven three-dimensional fabric while holding the warp rod group 1 in fixed state of the machine frame 10.

Since the beating member 31 is located above the weaving position, its pressing surface 32 can be used as a guide at the time of insertion of the weft rods 2*a*.

In operation of the rod piercing type three-dimensional multiple-axis fabric weaving machine of the above arrangement, the weft rods 2*a* are inserted from a plural number of directions into a large number of warp rods which are set in parallelly arrayed state by the holder table 11 of the warp rod group 1. While lowering the warp rod group 1 in step with the progress of the weaving process, the weft rods 2*a* are inserted at a plural number of positions corresponding to weft rod insert portions into the warp rod group 1 by operation of the rod inserter 15, protruding the corresponding push rods 20*a* or 20*b* by selectively actuating the drive members 21*a* or 21*b*. As a result, the weft rods which have been supplied onto the rod support surface 16 from the magazine 17 are pushed by the fore ends of the push rods 20*a* or 20*b* and successively inserted into the warp rod group 1 in a divided fashion.

The weft rods 2*a* which are protruded through the warp rod group 1 in the inserting operation by the rod inserter 15 are received at the respective force ends on the fabric guide 24 which constitutes a fall-preventive wall, and thereby retained in a predetermined woven state, while the woven fabric is guided by the fabric guide 24.

Figure 8:
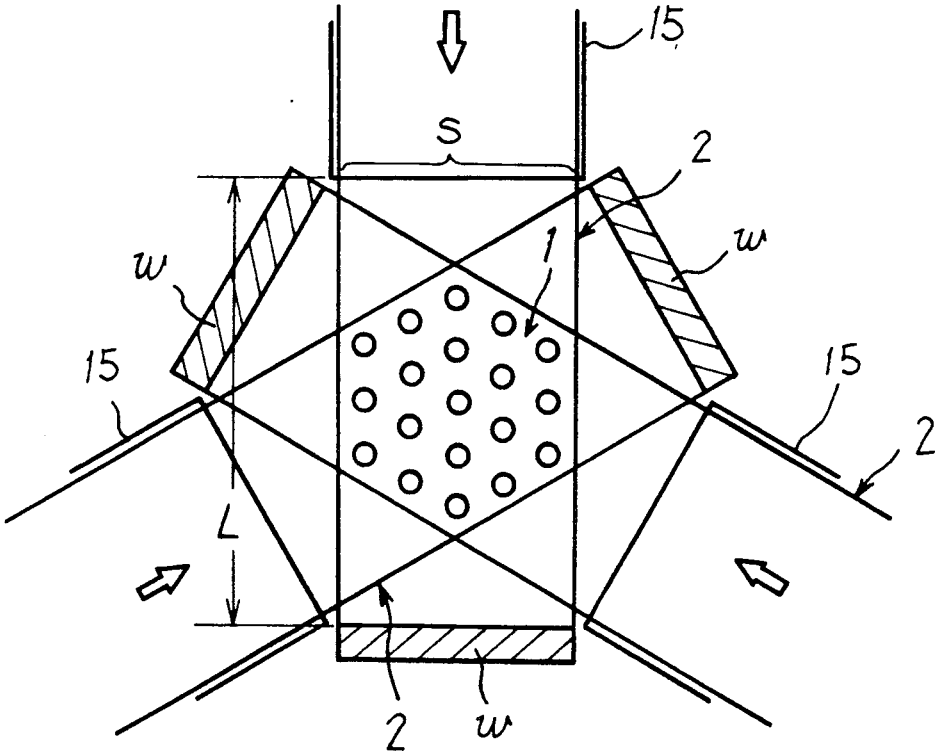
FIG. 8 PRIOR ART
FIG. 8 is a schematic illustration explanatory of the problems of prior art.

Thus, the cylindrical fabric guide 24 prevents the inserted weft rods 2*a* from falling off, and the warp rod group 1 is movable in the axial direction thereof relative to the fabric guide 24 and the rod inserter 15. Besides, the rod inserters 15 are arranged to insert the weft rods 2*a* at a position above the upper end of the fabric guide 24 or through notched grooves in the fabric guide 24. It follows that there is no need for taking into consideration the evasion of the fall-preventive wall in determining the location of the rod inserters 15 as explained hereinbefore with reference to FIG. 8, and the fall-preventive wall is formed by the fabric guide 24 irrespective of the rod inserters 15. Consequently, it becomes possible to set the weft rods 2*a* substantially in a length which is necessary for the weaving operation, precluding wasteful use of the weft rods.

What is claimed is:

1. A method of weaving a rod piercing type three-dimensional multiple-axis fabric wherein weft rods are inserted into a group of a large number of parallel arrayed warp rods successively from a plural number of inclined directions by the use of rod inserting means being moved relative to an in the axial direction of said warp rod group, said method comprising the steps of:

inserting weft rods through said warp rod group by means of said rod inserting means, while receiving protruded fore end portions of the inserted weft rods by a fabric guide constituting a fall-preventive wall located on the side of the fore ends of said inserted weft rods and having a cylindrical shape;

guiding a woven fabric by said cylindrical fabric guide in such a way as to envelop said woven fabric in small gap relation therewith when seen in the axial direction of the warp rods;

successively feeding said fabric guide in the axial direction of and relative to said warp rod group together with said rod inserting means, while inserting said weft rods by said rod inserting means at a position outside an end portion of said fabric guide or through notched grooves in said fabric guide.

2. A method of weaving a three-dimensional multiple-axis fabric as defined in claim 1, comprising the further steps of utilizing said fabric guide as a container for holding a matrix resin to be impregnated into said woven fabric, and supplying said matrix resin to said fabric guide during weaving operation to impregnate and cure the same in said woven fabric.

3. A method of weaving a three-dimensional multiple-axis fabric as defined in claim 1, comprising the further step of providing a taper on an inner periphery of said cylindrical fabric guide to have a sectional area converging gradually from a weaving position correspondingly to a position wherein shrinkage of the multiple-axis fabric from curing of a matrix resin applied thereto occurs.

4. A method of weaving a three-dimensional multiple-axis fabric as defined in claim 1, comprising: upon insertion of said weft rods, the further steps of arraying a weft rod group to be inserted from one direction in one cycle of weaving operation in parallel relation with each other in a plane perpendicularly intersecting a plane parallel with both said warp and said weft rods and containing said weft rods;

successively feeding the arrayed weft rods successively in the axial direction of and relative to said warp rod group; and selectively inserting said weft rods of each weaving cycle by means of a rod inserting means for divided insertion of said weft rods at a plural number of positions corresponding to weft rod insert portions into said warp rods.

5. A method of weaving a three-dimensional multiple-axis fabric as defined in claim 1 or 4, comprising the further step of: beating said inserted weft rods by moving said woven fabric and a rod pressing frame, located in an opposing relationship with inserted weft rods portions protruding out of said warp rod group, in the axial direction of and relative to said warp rod group.

6. A rod piercing type three-dimensional multiple-axis fabric weaving machine including a warp rod holder table for setting a warp rod group in a parallel arrayed state, and a rod inserter mounted movably in the axial direction of and relative to said warp rod group to insert weft rods into said warp rod group from a plural number of oblique directions, wherein said weaving machine comprises:

a fall-preventive wall located face to face with the weft rods to be inserted through said warp rod group by said rod inserter, and constituted by a cylindrical fabric guide enveloping a woven part of said fabric in small gap relation therewith, when seen in the axial direction of said warp rods;

said fabric guide being movable together with said rod inserter in the axial direction of and relative to said warp rod group; and said rod inserter being located to inset said weft rods at a position outside an end portion of said fabric guide or through notched grooves in said fabric guide.

7. A rod piercing type three-dimensional multiple-axis fabric weaving machine as defined in claim 6, wherein said fabric guide is used as a container for holding a matrix resin to be impregnated into woven fabric, and associated with a resin feeder having a resin supply port opened above said fabric guide to supply said matrix resin thereto.

8. A rod piercing type three-dimensional multiple-axis fabric weaving machine as defined in claim 7, wherein said fabric guide is provided with an energy supply means for curing the impregnated resin.

9. A rod piercing type three-dimensional multiple-axis fabric weaving machine as defined in claim 8, wherein said cylindrical fabric guide is tapered on the inner periphery thereof to have a gradually converging sectional area from a weaving position correspondingly to a position wherein shrinkage of the multiple-axis fabric from curing of a matrix resin applied thereto occurs.

10. A rod piercing type three-dimensional multiple-axis fabric weaving machine as defined in claim 6, wherein weft rods of a group to be inserted from one direction in one cycle of weaving operation are arrayed on a rod support surface perpendicularly intersecting a plane parallel with both said warp and said weft rods and containing said weft rods, and said rod inserter, adapted to push forward the arrayed weft rods on said rod support surface for insertion into said warp rods, divides the insertion of said weft rods correspondingly to a positional difference of said weft rods in the weaving direction in each cycle of weaving operation.

11. A rod piercing type three-dimensional multiple-axis fabric weaving machine as defined in claim 10, wherein for said divided insertion of said weft rods, said push rod is divided into push rod sections correspondingly to a plural number of parallel planes of weft rod insertion in deviated positions in a weaving direction, said push rod sections being located in face to face relation with said weft rods at the respective fore ends and separately coupled with drive members slidably mounted on a machine frame, a push rod section of the drive member located on the side away from said warp rod group being slidably passed through the drive member located on the side of said warp rod group, and the respective drive members being movable in the direction of weft rod insertion independently of each other by means of a drive mechanism coupled with said drive members.

12. A rod piercing type three-dimensional multiple-axis fabric weaving machine as defined in claim 10, wherein said rod inserter is provided with a plural number of push rods on a single drive member at intervals two times as wide as the pitch of rod arrangement of said warp rod group, in combination with a transverse drive mechanism arranged to move said rod inserter in the transverse direction by one pitch of said warp rod arrangement.

13. A rod piercing type three-dimensional multiple-axis fabric weaving machine as defined in claim 6, further comprising a rod pressing frame movable relative to said woven fabric in the axial direction of said warp rod group for a beating operation, said rod pressing frame being formed substantially in a ring-like shape circumventing said warp rod group in face to face relation with said inserted weft rod portions protruding outwardly through said warp rod group, and having a rod pressing surface which simultaneously abuts against said weft rods upon completion of weft rod insertion of one weaving cycle.

14. A rod piercing type three-dimensional multiple-axis fabric weaving machine as defined in claim 13, wherein said rod pressing frame of the weaving machine acts as a guide in the direction of the weft rod insertion.

* * * * *